US009917382B1

(12) United States Patent
Eberts et al.

(10) Patent No.: US 9,917,382 B1
(45) Date of Patent: Mar. 13, 2018

(54) MCCB CURRENT LIMITER LUG ADAPTER

(71) Applicant: Eaton Corporation, Cleveland, OH (US)

(72) Inventors: William George Eberts, Moon Township, PA (US); Frank Joseph Stifter, Jr., Bridgeville, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 15/254,231

(22) Filed: Sep. 1, 2016

(51) Int. Cl.

| | |
|---|---|
| ***H01H 71/08*** | (2006.01) |
| ***H01H 1/58*** | (2006.01) |
| ***H01R 9/24*** | (2006.01) |
| ***H01H 71/02*** | (2006.01) |

(52) U.S. Cl.
CPC ..... *H01R 9/2416* (2013.01); *H01H 71/025* (2013.01)

(58) Field of Classification Search
CPC ..... H01H 71/08–71/088; H01H 71/02; H01H 71/0207; H01H 1/58; H01H 1/5805
USPC ..... 335/202
See application file for complete search history.

(56) References Cited

U.S. PATENT DOCUMENTS

| | | | | |
|---|---|---|---|---|
| 3,848,161 | A * | 11/1974 | Clement | H02B 1/056 174/70 B |
| 4,093,970 | A * | 6/1978 | M'Sadoques | H02B 1/42 174/70 B |
| 4,646,199 | A | 2/1987 | M'Sadoques et al. | |
| 4,809,132 | A * | 2/1989 | Palmieri | H01H 71/08 335/202 |
| 5,107,396 | A * | 4/1992 | Rosen | H01H 71/08 361/634 |
| 5,269,710 | A * | 12/1993 | Donnerstag | H01H 71/08 439/810 |
| 5,831,498 | A | 11/1998 | Maloney et al. | |
| 7,250,836 | B2 * | 7/2007 | Fleege | H01H 71/08 335/202 |
| 2005/0057333 | A1 * | 3/2005 | Subramanian | H01H 1/2058 335/202 |

* cited by examiner

*Primary Examiner* — Gary Paumen
(74) *Attorney, Agent, or Firm* — Eckert Seamans; David Jenkins; Grant Coffield

(57) ABSTRACT

An adaptor assembly is provided. The adaptor assembly is structured to allow a cable of a first amperage to be coupled to, and placed in electrical communication with, a terminal of a different amperage. That is, an adaptor assembly includes a lug body and an adaptor body. The adaptor body is coupled to, and in electrical communication with, the lug body. The lug body includes a cable passage, wherein said cable passage has a cross-sectional area corresponding to a cable of a first amperage. The adaptor body includes a conducting surface, wherein said conducting surface has a surface area corresponding to a conductor terminal end mating surface of a second amperage.

4 Claims, 4 Drawing Sheets

MCCB CURRENT LIMITER LUG ADAPTER

BACKGROUND OF THE INVENTION

Field of the Invention

The disclosed and claimed concept relates to a current limiter and, more particularly, to a current limiter lug adapter that acts as an intermediary piece to connect a smaller lug to a larger conductor which, otherwise, would not be capable of accepting the larger conductor while utilizing substantially all of the current limiter lug adapter's conducting surface.

Background Information

As is known, a circuit breaker includes a housing assembly, an operating mechanism, a conductor assembly and a trip assembly. The circuit breaker housing assembly defines a number of enclosed spaces and cavities. The operating mechanism and the trip assembly are generally disposed in the circuit breaker housing assembly enclosed spaces. The conductor assembly has a number of conductor members including a movable conductor(s) and a fixed conductor(s). A movable contact is coupled to each movable conductor. A fixed contact is coupled to each fixed conductor. The operating mechanism is structured to move the movable conductor, and therefore the movable contact, between a first position, wherein the movable contact is not coupled to, or in electrical communication with, the fixed contact, and, a second position wherein the movable contact is coupled to, and in electrical communication with, the fixed contact. The trip assembly is structured to actuate the operating mechanism in the event of an over-current condition. The operating mechanism is also structured to be manually actuated.

The fixed conductor is structured to be coupled to, and in electrical communication with, a line bus and the movable conductor is structured to be coupled to, and in electrical communication with, a load bus. That is, each fixed and movable conductor includes a portion that extends outside of the circuit breaker housing assembly enclosed space. The exposed portion of a conductor is identified herein as a terminal. Each terminal is disposed in a circuit breaker housing assembly terminal cavity. Each terminal has a generally planar body with a wide upper surface and a wide lower surface. Further, in an exemplary embodiment, each terminal includes a passage between the wide upper surface and the wide lower surface. The upper surface of a terminal is a mating surface that is structured to be coupled to a lug, described below.

The terminal cavity also accommodates a lug that is structured to be coupled to, and placed in electrical communication with, a line or load bus. While the line/load bus may have any shape or cross-sectional area, in an exemplary embodiment, the line/load bus is a cable having a generally circular cross-sectional area. The lug includes a body defining a cavity, a conductor passage into the cavity, and a coupling passage into the cavity. Generally, the conductor passage is, as shown in the figures, a generally horizontal passage and the coupling passage is generally vertical. The coupling passage is threaded and a threaded element is rotatably disposed in the coupling passage. In this configuration, a line/load bus, i.e., a line/load cable, is passed through the conductor passage into the lug body cavity. The threaded element is then drawn downward to compress the line/load cable thereby securing, and electrically coupling, the line/load cable to the lug body. Further, the lug body includes a generally flat lower surface and two downwardly extending protrusions. The protrusions are spaced so that their inner surfaces are about the same distance apart as the width of a terminal. In this configuration, and when the lug is installed, the protrusions are disposed on either side of a terminal and the lug body generally flat lower surface is disposed on, and is in electrical communication with, the terminal mating surface.

The terminal, the lug and the cable are sized according to the amperage that the circuit breaker is structured to accommodate. Generally, the greater the amperage, the larger the elements. Moreover, each of these elements is sized and shaped to be coupled to other elements that are structured to accommodate the same amperage. That is, for example, a fifteen (15) amp lug is not sized and shaped to fit onto a two-hundred and fifty (250) amp terminal By having the elements sized and shaped to accommodate a specific amperage, or range of amperages, there is a reduced chance that a technician will, for example, couple a high amperage cable to a low amperage lug. Further, because of this, a lug is identified as a "current limiter" in that a cable structured to carry a higher amperage cannot fit within the cable passage of a lug structured to accommodate a lower amperage. Similarly, a cable structured to accommodate a lower amperage cable would be loose within a higher amperage lug.

This configuration, however, has disadvantages. Generally, a higher amperage circuit breaker can accommodate the current associated with a lower amperage line/load. Thus, the configuration of the current limiting lug is what prevents coupling a lower amperage line/load cable to a higher amperage circuit breaker.

SUMMARY OF THE INVENTION

The disclosed and claimed adaptor assembly is structured to allow a cable of a first amperage to be coupled to, and placed in electrical communication with, a terminal of a different amperage. That is, an adaptor assembly includes a lug body and an adaptor body. The adaptor body is coupled to, and in electrical communication with, the lug body. The lug body includes a cable passage, wherein said cable passage has a cross-sectional area corresponding to a cable of a first amperage. The adaptor body includes a conducting surface, wherein said conducting surface has a surface area corresponding to a conductor terminal end mating surface of a second amperage.

The configuration of the adaptor and the adaptor assembly described below solve the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
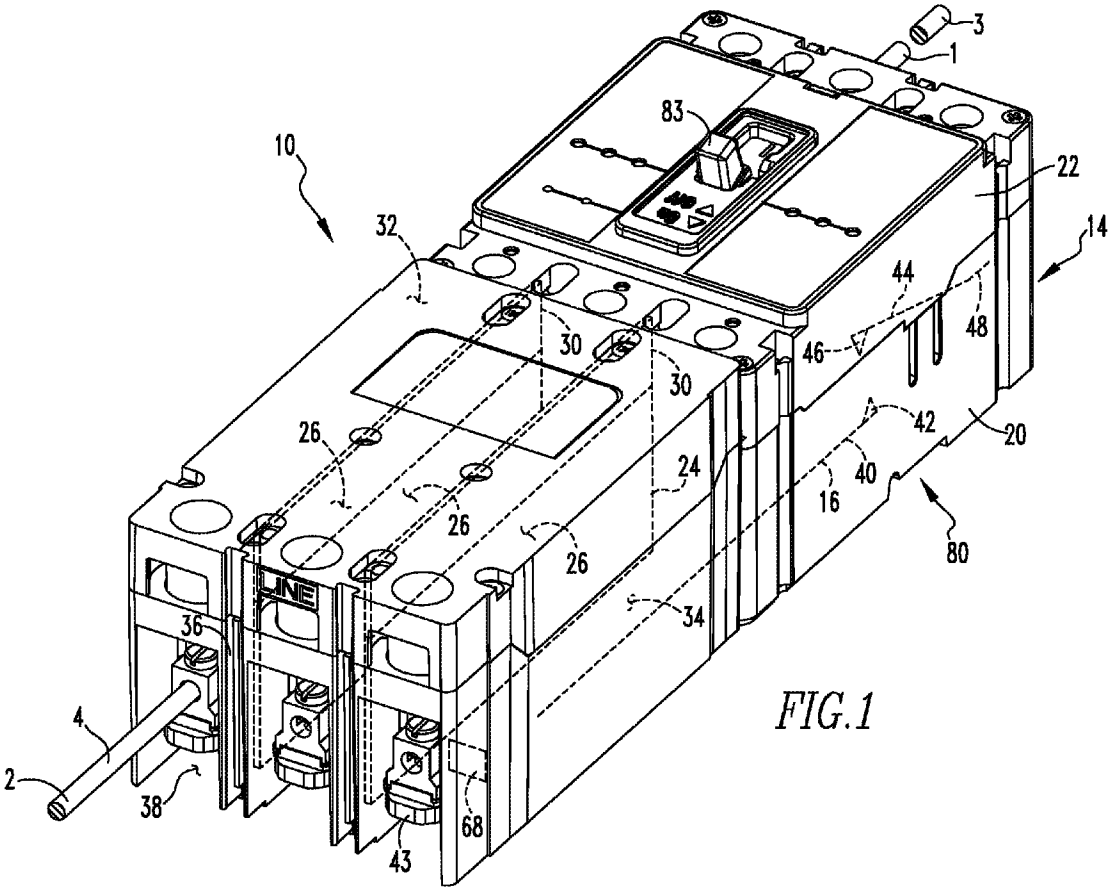
FIG. 1 is an isometric view of a circuit breaker including schematic elements.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. Further, as used herein, "loosely correspond" means that a slot or opening is sized to be larger than an element disposed therein. This means that the increased size of the slot or opening is intentional and is more than a manufacturing tolerance. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." When used in association with an electrical current, a "path" includes the elements through which the current travels.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally" means "in a general manner" relevant to the term being modified as would be understood by one of ordinary skill in the art.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, when elements are in "electrical communication" a current may flow between the elements. That is, when a current is present and elements are in "electrical communication," then the current flows between the elements. It is understood that elements that are in "electrical communication" have a number of conductive elements, or other constructs, disposed therebetween creating the path for the current.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces. The perimeter, and therefore the edge surface, may include generally straight portions, e.g., as on a rectangular planar member, or be curved, as on a disk, or have any other shape. Further, a "unitary planar member" includes all of a construct generally disposed in a similar plane. That is, for example, a flat single sheet of paper is a single "unitary planar member" and not two or more planar members disposed adjacent to each other. Stated alternately, a "unitary planar member" extends between the edges of a generally planar construct and is not a portion thereof. Thus, as used herein, in a tiered construct, including a unitary body tiered construct, each tier is a "planar member" wherein the planar members are divided by a plane(s) extending generally parallel to the flat surfaces of the planar members. That is, each "planar member" is that portion of the construct between the edges of a tier.

As used herein, components "of an [X] amperage" are designed and built to accommodate a selected current while minimizing costs and space. That is, electrical components, i.e., those components that carry a current, are designed and built to accommodate a selected current while minimizing costs and space. That is, just as a delivery company would not use a cargo ship to deliver a single package, those of ordinary skill in the art understand that electrical components having selected characteristics are designed and used to accommodate selected currents. Further, while, in general, a larger component could also accommodate a lower current, those of skill in the art would not use such a larger components as it wastes material and typically costs more. Thus, as used herein, components "of a [first/second/etc.] amperage" are those components that one of ordinary skill in the art would use to accommodate a selected current without having any characteristic that is inadequate (e.g., too small) or excessive (e.g., too large).

A molded case circuit breaker assembly 10 (hereinafter "circuit breaker" 10) is coupled to, and is in electrical communication with, both a line conductor 1 and a load conductor 2. In an exemplary embodiment, the line conductor 1 and the load conductor 2 are each a cable 3, 4, respectively, having a generally circular cross-section. Each cable 3, 4 is structured to accommodate a current of a selected amperage. That is, the line cable 3 is of a first amperage and the load cable 4 is of a second amperage. The first amperage and the second amperage are different. In an exemplary embodiment, the first amperage is lower than the second amperage.

Figure 2:
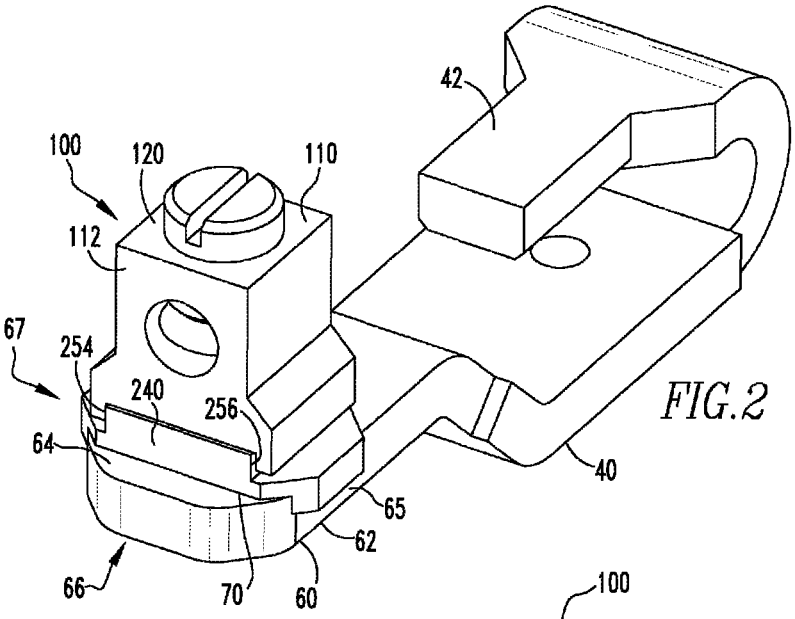
FIG. 2 is an isometric view of a shortened stationary conductor and an adaptor assembly.

As shown in FIG. 1, the circuit breaker assembly 10 includes a housing assembly 12, an operating mechanism 14 and a number of conductor assemblies 16, shown schematically. Each conductor assembly 16 includes a pair of separable contacts 18. Typically, there is one conductor assembly 16 for each pole of the circuit breaker 10. An exemplary three-pole circuit breaker 10 is shown. The housing assembly 12 defines an enclosed space (not shown). The housing assembly 12 includes an elongated base portion which is coupled to an elongated primary cover 22 (FIG. 2). The base portion 20 includes a plurality of internal walls 24 defining number of elongated cavities 26. In an exemplary embodiment, there is one cavity 26 for each pole of the circuit breaker 10. The primary cover 22 also includes a plurality of internal walls 30 which also define a number of elongated cavities 32. As noted above, in a three-pole circuit breaker 10 there are three base portion cavities 26 and three primary cover cavities 32. The base portion cavities 26 and primary cover cavities 32 extend generally parallel to each other and parallel to a longitudinal axis of the housing assembly 12. The base portion cavities 26 generally align with the primary cover cavities 32 so that when the primary cover 22 is coupled to the base portion 20, the base portion cavities 26 and the primary cover cavities 32 define a number of conductor chambers 34, and in an exemplary embodiment with a three-pole circuit breaker 10, three conductor chambers 34.

Further, the base portion 20 includes external walls 36 that generally align with the base portion internal walls 24. The base portion external walls 36 define a number of terminal cavities 38 which are associated with one housing assembly cavity 26. That is, each terminal cavity 38 is aligned with one housing assembly cavity 26 and, as used herein is part of, or included with, the associated housing assembly cavity 26. In each terminal cavity 38, the base portion 20 includes a passage to the housing assembly enclosed space.

Each conductor assembly 16 includes substantially similar elements and, as such, only one conductor assembly 16 will be described. It is understood that the elements described are associated with a single conductor assembly 16 and each conductor assembly 16 has a similar set of associated elements. Each conductor assembly 16 includes an elongated stationary conductor 40, a stationary contact 42, a movable conductor 44, a movable contact 46, and a movable conductor fixed portion 48. The separable contacts 18 include the stationary contact 42 and the movable contact 46. Each conductor assembly 16 is substantially disposed in the housing assembly enclosed space.

The stationary contact 42 is coupled to, and in an exemplary embodiment directly coupled to, as well as in electrical communication with, the stationary conductor 40. In another exemplary embodiment, the stationary contact 42 is unitary with, the stationary conductor 40. The stationary conductor 40 includes a first end 43. When the stationary conductor 40 is disposed in a conductor chamber 34, the stationary conductor first end 43 extends through the base portion passage and into a terminal cavity 38. Thus, as used herein, the stationary conductor first end 43 is also identified as a conductor terminal end 60, which is described in detail below.

The movable contact 46 is coupled to, and in an exemplary embodiment directly coupled to, as well as in electrical communication with, the movable conductor 44. In an exemplary embodiment, the movable contact 46 is unitary with the movable conductor 44. The movable conductor 44 is movably coupled to, and is in electrical communication with, the movable conductor fixed portion 48. The movable contact 46, and more specifically, the movable conductor 44, is coupled to an operating mechanism 14. The operating mechanism 14 is structured to move the movable contact 46 between a first, open position wherein the contacts 18 are separated and are not in electric communication, and, a second, closed position wherein the contacts 18 are coupled (or directly coupled) and are in electrical communication.

The movable conductor fixed portion 48 also includes a first end (not shown). As with the stationary conductor first end 43, when the movable conductor fixed portion first end is disposed in a conductor chamber 34, the movable conductor fixed portion first end extends through the base portion passage and into a terminal cavity 38. Thus, as used herein, the movable conductor fixed portion first end is also identified as a conductor terminal end 60, which is described in detail below.

As shown in FIG. 2, which shows a stationary conductor with a shortened length, each terminal end 60, in an exemplary embodiment, includes a generally planar body 62 (which is unitary with either a stationary conductor 40 or a movable conductor fixed portion 48) having a wide upper surface 64 and a wide lower surface 66 as well as thinner side surfaces including a first lateral side 65 and a second lateral side 67. Each terminal end 60 has a width which is the distance between the first lateral side 65 and the second lateral side 67. Each terminal end 60 further includes a passage 68 extending between the terminal end upper surface 64 and the terminal end lower surface 66. Further, each terminal end upper surface 64 defines, or includes, a mating surface 70. Each mating surface 70 is structured to be coupled or directly coupled to, and in electrical communication with, an adaptor body conducting surface 216, described below. Further, it is understood that each terminal end 60 is structured to accommodate a current within a selected amperage range or a selected amperage. In an exemplary embodiment, each terminal end 60 is of a second amperage. Thus, each mating surface 70 is a mating surface 70 of a second amperage. In an exemplary embodiment, the second amperage is between about fifteen (15) amps to thirty-five (35) amps, or, in an exemplary embodiment, about twenty-five (25) amps. In this embodiment, each mating surface 70 has an area of between about 0.507 in.$^2$ to 0.533 in.$^2$, or, in an exemplary embodiment, about 0.520 in.$^2$ The operating mechanism 14 is coupled to a trip assembly 80 and a handle 83. The handle 83 is part of the operating mechanism 14. The operating mechanism 14 may be actuated manually by the handle 83, or, actuated, in response to an over-current condition, by the trip assembly 80. The operating mechanism 14 and the trip assembly 80 are substantially disposed in the housing assembly enclosed space.

An adaptor assembly 100 is structured to couple, and place in electrical communication, a cable 3 of a first amperage to a terminal end 60 of a second amperage. In an exemplary embodiment, the adaptor assembly 100 includes a lug assembly 110 and an adaptor member assembly 200. The lug assembly 110 and adaptor member assembly 200 are coupled or directly coupled to each other and are in electrical communication with each other. The lug assembly 110 is structured to be coupled to, and placed in electrical communication with, a conductor 1, 2 or, in an exemplary embodiment, a cable 3, 4 of a first amperage. The adaptor member assembly 200 is structured to be coupled to, and placed in electrical communication with, a terminal end 60 of a second amperage.

Figure 3:
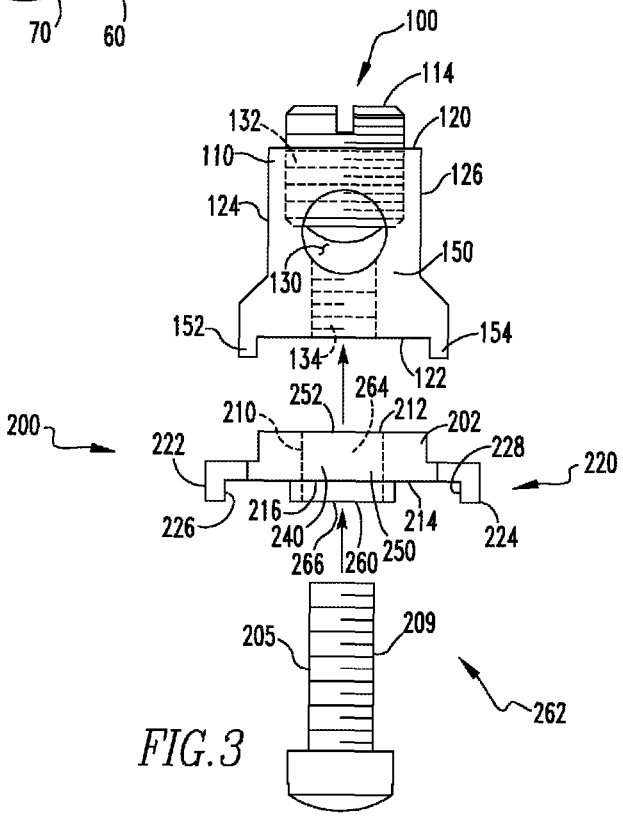
FIG. 3 is an exploded view of an adaptor assembly.
Figure 4:
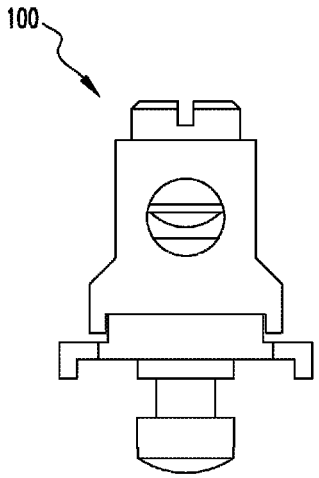
FIG. 4 is a front view of an adaptor assembly.
Figure 5:
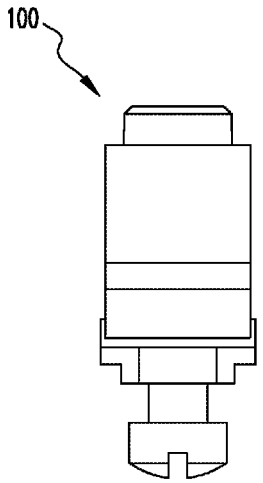
FIG. 5 is a right side view of an adaptor assembly.
Figure 6:
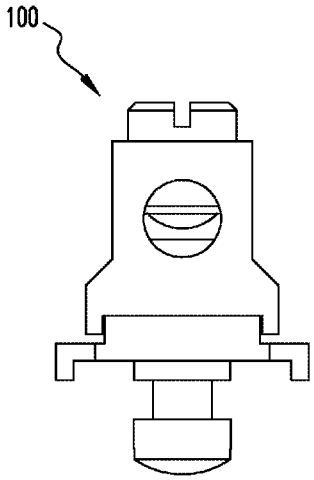
FIG. 6 is a back view of an adaptor assembly.
Figure 7:
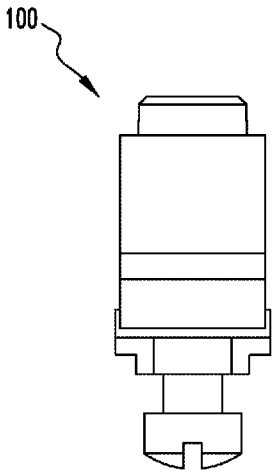
FIG. 7 is a left side view of an adaptor assembly.
Figure 8:
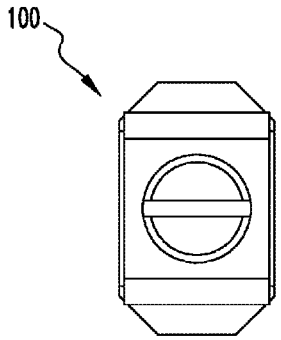
FIG. 8 is a top view of an adaptor assembly.
Figure 9:
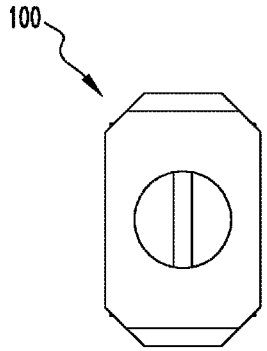
FIG. 9 is a bottom view of an adaptor assembly.

As shown in FIG. 3, and in an exemplary embodiment, the lug assembly 110 includes a conductive body 112 and a threaded element 114. The lug assembly body 112 (hereinafter "lug body" 112) is, in an exemplary embodiment, a parallelepiped having an upper surface 120, a lower surface 122, a first side surface 124 and a second side surface 126, as well as two lateral surfaces (not numbered). The lug body first side surface 124 is disposed opposite the lug body second side surface 126. The lug body 112 includes a cable passage 130 that extends between the lug body first side surface 124 and the lug body second side surface 126. The cable passage 130 has a cross-sectional area corresponding to a cable 3 of a first amperage. The lug body 112 also includes a coupling passage 132. The lug body coupling passage 132 extends from the lug body upper surface 120 to the cable passage 130. The lug body coupling passage 132 is, in an exemplary embodiment, threaded. The threaded element 114 corresponds to the lug body coupling passage 132. In this configuration, when a cable 3 is disposed in the coupling passage 132, the threaded element 114 is structured to be moved toward the cable 3 thereby securing the cable 3 in the coupling passage 132. The lug body 112 also includes a mounting passage 134. The lug body mounting passage 134 extends from the lug body lower surface 122 toward the coupling passage 132 and, in an exemplary embodiment, extends to the cable passage 130. The lug body mounting passage 134 is, in an exemplary embodiment, threaded.

In an exemplary embodiment, the lug body 112 includes a center portion 150, a first anti-rotation protrusion 152 and a second anti-rotation protrusion 154. The lug body center portion 150 is substantially the lug body 112 with the various passages 130, 132, 134, as described above. The first anti-rotation protrusion 152 extends from the lug body center portion 150 in a first direction (downwardly as shown). In an exemplary embodiment, the first anti-rotation protrusion 152 extends from the periphery of the lug body center portion 150. Similarly, the second anti-rotation protrusion 154 extends from the lug body center portion 150 in a first direction, i.e., the same direction as the first anti-rotation protrusion 152. In an exemplary embodiment, the second anti-rotation protrusion 154 extends from the periphery of the lug body center portion 150. In an exemplary embodiment, the lug body center portion 150, the first anti-rotation protrusion 152 and the second anti-rotation protrusion 154 are unitary.

The adaptor member assembly 200 includes a conductive body 202 and a mounting coupling component 204. The adaptor member assembly body 202 (hereinafter the "adaptor body" 202) includes a generally planar center portion 210 having an upper surface 212 and a lower surface 214. The adaptor body 202 also includes a conducting surface 216 which, in an exemplary embodiment, is the adaptor body lower surface 214. The conducting surface 216 has a surface area corresponding to a conductor terminal end mating surface 70 of a second amperage.

In an exemplary embodiment, the adaptor body 202 includes an anti-rotation component 220 structured to prevent rotation of the adaptor body 202 relative to a conductor terminal end 60. In an exemplary embodiment, the anti-rotation component 220 includes a first anti-rotation protrusion 222 and a second anti-rotation protrusion 224. The adaptor body first anti-rotation protrusion 222 extends from the adaptor body center portion 210 in a first direction (downwardly as shown). In an exemplary embodiment, the adaptor body first anti-rotation protrusion 222 is an elongated member including an inner surface 226. Further, in an exemplary embodiment, the adaptor body first anti-rotation protrusion 222 extends from the periphery of the adaptor body center portion 210. Similarly, the adaptor body second anti-rotation protrusion 224 extends from the adaptor body center portion 210 in a first direction, i.e., in the same direction as the adaptor body first anti-rotation protrusion 222. In an exemplary embodiment, the adaptor body second anti-rotation protrusion 224 is an elongated member including an inner surface 228. Further, in an exemplary embodiment, the adaptor body second anti-rotation protrusion 224 extends from the periphery of the adaptor body center portion 210. The adaptor body first anti-rotation protrusion inner surface 226 and the adaptor body second anti-rotation protrusion inner surface 228 are spaced apart by a distance generally corresponding to the conductor terminal end 60 width.

In an exemplary embodiment, the adaptor body 202 includes a mating component 240. The mating component 240 is structured to be coupled to the lug body 112 and to orient the lug body 112 with the conductor terminal end 60. As used herein, to "orient the lug body with the conductor terminal end" means that the lug body 112 is oriented so that the longitudinal axis of the cable passage 130, i.e., an axis extending between lug body first side 124 and the lug body second side 126, is generally aligned with the longitudinal axis of the stationary conductor 40 or movable conductor fixed portion 48 that includes the terminal end 60 to which the adaptor body 202 is coupled, as discussed below.

In an exemplary embodiment, the adaptor body center portion 210 includes a tier 250. The adaptor body center portion tier 250 is, in an exemplary embodiment, a planar body 252 having a smaller width relative to the adaptor body center portion 210. In this configuration, the adaptor body center portion tier 250 includes a first lateral side 254 and a second lateral side 256 (FIG. 2). In an exemplary embodiment, the adaptor body center portion tier first lateral side 254 and the adaptor body center portion tier second lateral side 256 are spaced apart by a distance generally corresponding to the distance between the lug body first anti-rotation protrusion inner surface 226 and the lug body second anti-rotation protrusion inner surface 228.

In an exemplary embodiment, the adaptor body 202 includes an alignment component 260. The alignment component 260 is structured to align the adaptor body 202 on a conductor terminal end 60. As used herein, to "align the adaptor body on a conductor terminal end" means to center the adaptor body 202 on an associated conductor terminal end 60. In an exemplary embodiment, the alignment component 260 includes a protrusion 262 extending from the conducting surface 216. Further, the alignment component protrusion 262 (hereinafter "alignment protrusion" 262) is sized and shaped to correspond to the conductor terminal end passage 68.

In an exemplary embodiment, the adaptor body 202 includes a passage 264. The adaptor body passage 264 loosely corresponds to the adaptor member assembly mounting coupling component 204. Further, in this embodiment, the alignment protrusion 262 is a collar 266 that extends about the adaptor body passage 264.

The adaptor member assembly mounting coupling component 204 is, in an exemplary embodiment, a fastener such as, but not limited to a bolt 205. The adaptor member assembly mounting coupling component 204 is sized and shaped to correspond to the lug body mounting passage 134.

The adaptor assembly 100 is assembled and installed (with no current flowing) as follows. The lug body 112 is coupled to the adaptor body 202 with the adaptor body center portion tier 250 disposed between the lug body first anti-rotation protrusion inner surface 226 and the lug body second anti-rotation protrusion inner surface 228. The adaptor assembly 100 is positioned on a terminal end 60 with the alignment protrusion 262 disposed in the conductor terminal end passage 68. Further, the adaptor body first anti-rotation protrusion 222 is disposed adjacent, or immediately adjacent, the terminal end first lateral side 65 and the adaptor body second anti-rotation protrusion 224 is disposed adjacent, or immediately adjacent, terminal end second lateral side 67. The adaptor member assembly mounting coupling component 204 is passed through the conductor terminal end passage 68 and the adaptor body passage 264 and is threadably coupled to the lug body mounting passage 134. A cable 3 is moved into the cable passage 130 and the threaded element 114 is moved toward the cable 3 thereby securing the cable 3 in the coupling passage 132.

In this configuration, the cable 3 of a first amperage is coupled to, and in electrical communication with, the lug body 112. The lug body 112 is coupled to, and in electrical communication with, the adaptor body 202. The adaptor body 202 is coupled to, and in electrical communication with, the terminal end 60 at the conductor terminal end mating surface 70 of a second amperage. Thus, the cable 3 of a first amperage is coupled to, and in electrical communication with, the terminal end 60 of a second amperage. This configuration solves the problems stated above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a housing assembly;

said housing assembly defining a number of cavities, each said cavity including a terminal cavity;

a conductor assembly;

said conductor assembly including a number of elongated conductors, each said conductor including a terminal end;

each conductor terminal end including a mating surface of a second amperage;

each said conductor terminal end disposed in a terminal cavity;

an adaptor assembly, a lug body and an adaptor body;

said adaptor body coupled to, and in electrical communication with, said lug body;

said lug body including a cable passage, wherein said cable passage has a cross-sectional area corresponding to a cable of a first amperage; and said adaptor body includes a conducting surface, wherein said conducting surface has a surface area corresponding to said conductor terminal end mating surface of a second amperage.

2. The circuit breaker of claim 1 wherein said adaptor body includes an alignment component structured to align said adaptor body on said conductor terminal end.

3. The circuit breaker of claim 1 wherein:

said adaptor body includes an anti-rotation component; and said anti-rotation component structured to prevent rotation of said adaptor body relative to said conductor terminal end.

4. The circuit breaker of claim 1 wherein:

said adaptor body includes a mating component;

said mating component structured to be coupled to said lug body and to orient said lug body with said conductor terminal end.

* * * * *